United States Patent [19]

Pearson, deceased et al.

[11] Patent Number: 4,919,234

[45] Date of Patent: Apr. 24, 1990

[54] PORTABLE LIFT

[76] Inventors: Theodore S. Pearson, deceased, late of Callender; by Diane M. Pearson, executor, 4011 Hunter St., Callender, both of Iowa 50523

[21] Appl. No.: 269,579

[22] Filed: Nov. 9, 1988

[51] Int. Cl.[5] ..... B66B 9/20

[52] U.S. Cl. ..... 187/9 R; 182/141; 254/93 R; 280/763.1

[58] Field of Search ..... 187/9 R, 9 E, 17; 182/145, 141, 63; 254/89 H, 93 VA, 93 R, 2 R; 280/763.1, 766.1; 108/137

[56] References Cited

U.S. PATENT DOCUMENTS

| | | | |
|---|---|---|---|
| 2,479,623 | 8/1949 | Johnson | 182/145 |
| 2,576,907 | 11/1951 | Wallace | 254/93 R |
| 2,670,811 | 3/1954 | Shaffer | 254/93 R |
| 3,110,359 | 11/1963 | Solomon | 182/63 |
| 3,556,249 | 1/1971 | Jackson | 182/63 |
| 3,576,233 | 4/1971 | Thatcher | 182/145 |
| 3,638,757 | 2/1972 | Sampson | 182/63 |
| 3,664,459 | 5/1972 | Stephens et al. | 182/63 |
| 3,735,958 | 5/1973 | Hollingsworth | 254/93 R |
| 3,820,631 | 6/1974 | King et al. | 182/141 |
| 3,831,901 | 8/1974 | Williams et al. | 254/93 R |
| 3,858,688 | 1/1975 | Galloway | 187/9 R |
| 4,171,033 | 10/1979 | Rust et al. | 182/63 |

FOREIGN PATENT DOCUMENTS

| | | | |
|---|---|---|---|
| 3711232 | 10/1987 | Fed. Rep. of Germany | 187/9 R |

*Primary Examiner*—Kevin P. Shaver
*Assistant Examiner*—Kenneth Noland
*Attorney, Agent, or Firm*—Zarley, McKee, Thomte, Voorhees & Sease

[57] ABSTRACT

The portable lift of the present invention includes a forward lift frame and a rear lift frame adapted to be connected to the forward and rear ends of the vehicle. Each of the lift frames includes a vertical tube or mast assembly having at least two telescopically extensible tube sections. Hydraulic extensible cylinders are within the tube assemblies of the forward and rear lift frames for causing the raising and lowering of the forward and rear lift frames between retracted and extended positions. An elongated support platform is pivotally connected to the upper ends of the tube lift assembly and is adapted to be raised and lowered in unison therewith.

7 Claims, 4 Drawing Sheets

PORTABLE LIFT

BACKGROUND OF THE INVENTION

This invention relates to a portable lift.

Prior art portable lifts have been provided which are adapted to be mounted to a vehicle and which are adapted to lift a person to a desired height for working on an object. Many of these devices are very complicated and utilize scissors linkages for lifting the work platform to the desired height.

One disadvantage of many prior art devices is the inability to mount these devices on a pickup truck in such a manner that they do not interfere with the carrying capacity of the box in the rear of the pickup truck.

Another problem encountered with prior art devices is the difficulty in using telescoping hydraulic cylinders for raising and lowering the device without the use of scissors linkages.

Another difficulty encountered with prior art devices is the difficulty in leveling the devices on uneven terrain so that the platform will be maintained in a level condition when elevated.

Therefore, a primary object of the present invention is the provision of an improved portable lift.

A further object of the present invention is the provision of an improved portable lift which can be mounted on a pickup and which minimizes the interference with the carrying capacity of the pickup truck.

A further object of the present invention is the provision of an improved portable lift which utilizes a front hydraulic cylinder and a rear hydraulic cylinder for telescoping between a retracted and extended position in order to raise and lower the platform.

A further object of the present invention is the provision of an improved portable lift which can be leveled on uneven terrain prior to being lifted to the desired working position.

A further object of the present invention is the provision of an improved portable lift which includes a platform capable of being extended laterally after the lift has been raised to its elevated position.

A further object of the present invention is the provision of an improved portable lift which utilizes a three section hydraulic assembly located within an extensible tube assembly.

A further object of the present invention is the provision of a portable lift having extensible hydraulic cylinders which include internal conduits for delivering hydraulic fluid to extend and retract the cylinder assemblies.

A further object of the present invention is the provision of a device which is economical to manufacture, durable in use, and efficient in operation.

BRIEF DESCRIPTION OF THE INVENTION

The present invention utilizes a portable lift having a front mast or tube assembly and a rear mast or tube assembly which are capable of being attached to the vehicle frame in the place where the front and rear bumpers are normally located. Connected to the upper ends of the mast assemblies and extending therebetween is an elongated platform. The platform is pivotally connected to each of the front and rear mast assemblies for pivotal movement about an axis which is transverse to the direction of movement of the vehicle.

Within each mast assembly is a three section hydraulic cylinder. The innermost section of the cylinder includes two conduits extending therethrough for carrying hydraulic fluid from the lower end thereof to the upper end thereof. These conduits carry fluid to permit the expansion and contraction of the cylinder assembly for raising and lowering the front and rear ends of the platform to the desired height. Because internal conduits are used within the cylinder assembly, it is not necessary to have hydraulic lines extending upwardly to the upper ends of the mast assembly, since the hydraulic lines can be connected to the lower end of the mast assembly, and the hydraulic fluid is then carried upwardly within the internal conduits in the hydraulic cylinder sections.

The device can be mounted to a pickup with a minimum amount of interference with the box portion at the rear of the pickup so that the box portion can be utilized for carrying objects, while at the same time the vehicle can be used to transport the lift.

The support platform at the upper end of the lift includes a lateral extension frame which permits the platform to be extended laterally to create a greater working support surface after the device has been elevated.

Outriggers are provided on the front and rear mast assemblies so as to provide four extensible feet which can be independently extended so as to permit the leveling of the device on uneven terrain.

BRIEF DESCRIPTION OF THE DRAWINGS

FIG. 9 is an enlarged elevational detail taken along line 9—9 of FIG. 2 and showing the extensible platform.

DESCRIPTION OF THE PREFERRED EMBODIMENT

Figure 1:
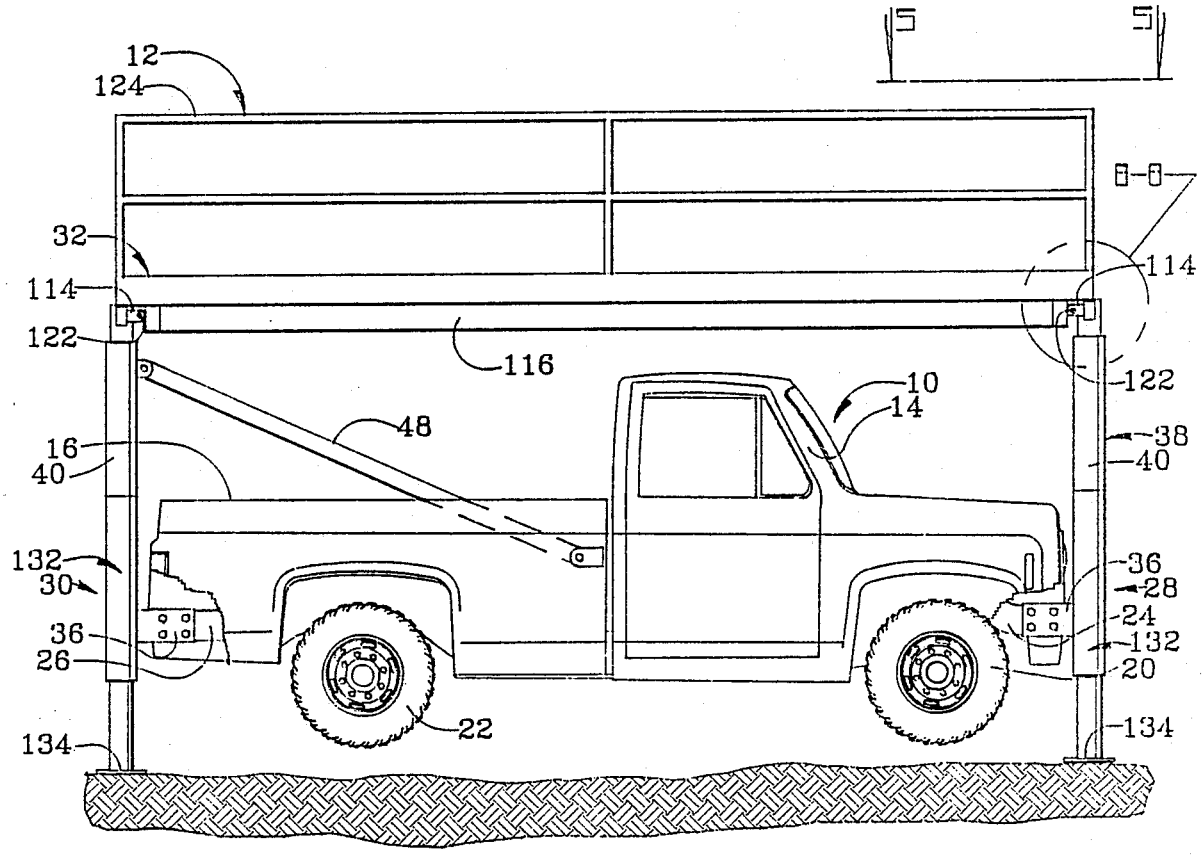
FIG. 1 is a side elevation of a pickup truck having the portable lift of the present invention mounted thereon.

Referring to the drawings, the numeral 10 generally refers to a conventional pickup truck having a portable lift 12 of the present invention mounted thereon. Vehicle 10 includes a cab portion 14 and a carrying box 16 having a bed 18 therein. Truck 10 is supported by front and rear wheels 20, 22 and includes a vehicle frame having a forward end 24 and a rear end 26 adapted normally to be mounted to the bumpers of the vehicle.

Figure 10:
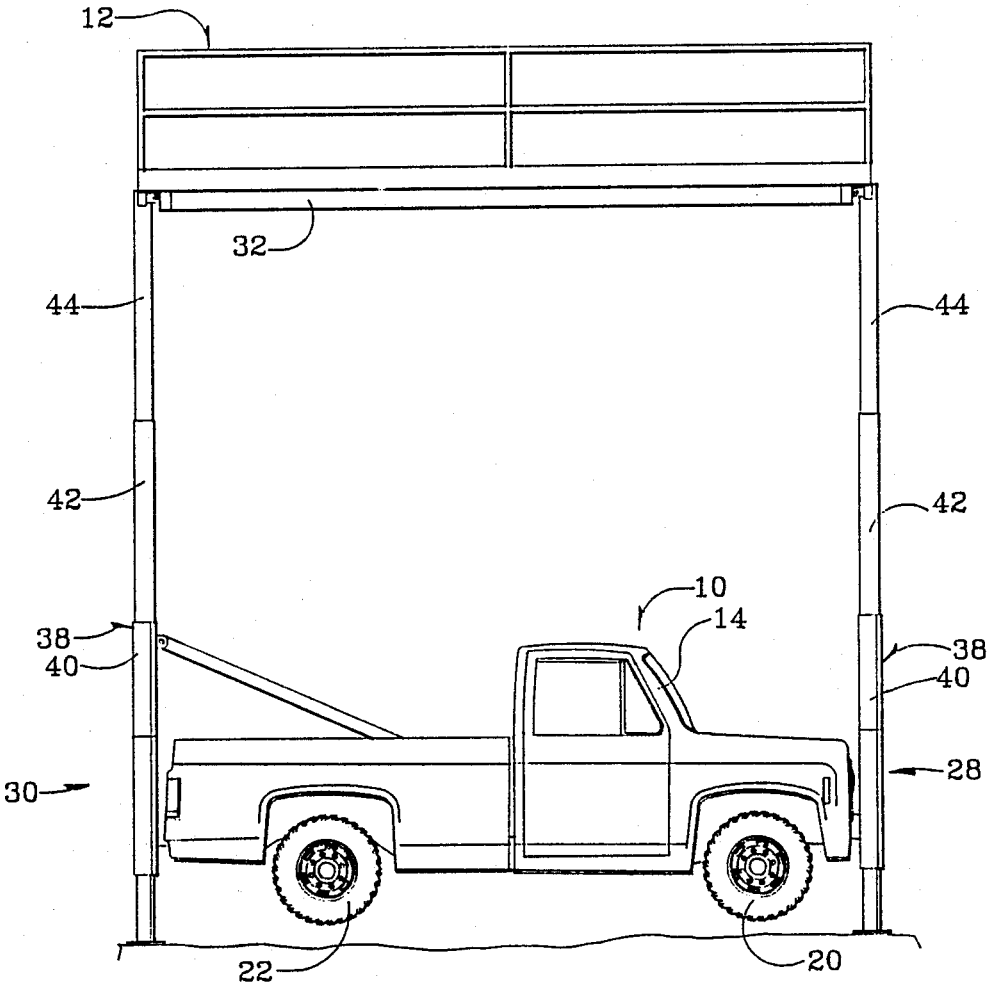
FIG. 10 is a view similar to FIG. 1, but showing the platform in an elevated position.

Portable lift 12 comprises a front frame assembly 28, a rear frame assembly 30, and an upper horizontal platform assembly 32. Front frame assembly 28 and rear frame assembly 30 are substantially identical in construction and include a horizontal frame member 34 which includes attaching brackets 36 for rigid attachment to the front and rear ends 24, 26 of the frame of vehicle 10. Extending upwardly from horizontal frame member 34, and rigidly attached thereto is a vertical mast or tube assembly 38. Tube assembly 38 comprises a lower tube section 40, a middle tube section 42, and an upper tube section 44, which are telescopically mounted with respect to one another and which are shown in detail in FIGS. 5 and 10. Lower tube section 40 is welded or otherwise rigidly secured to horizontal frame member 34 and extends upwardly therefrom. A lateral strut member 46 is connected at its upper end to lower tube section 40 and angles downwardly therefrom to its lower end which is rigidly secured to horizontal frame member 34. A longitudinal strut 48 (FIG. 5) is attached at its upper end to the upper end of lower tube section 40 of rear frame assembly 30 and extends forwardly therefrom for detachable securement to truck 10 within carrying box 16. Together the lateral strut 46 and the longitudinal strut 48 stabilize the securement of mast or tube assembly 38 in both the longitudinal and lateral directions with respect to vehicle 10.

Figure 5:
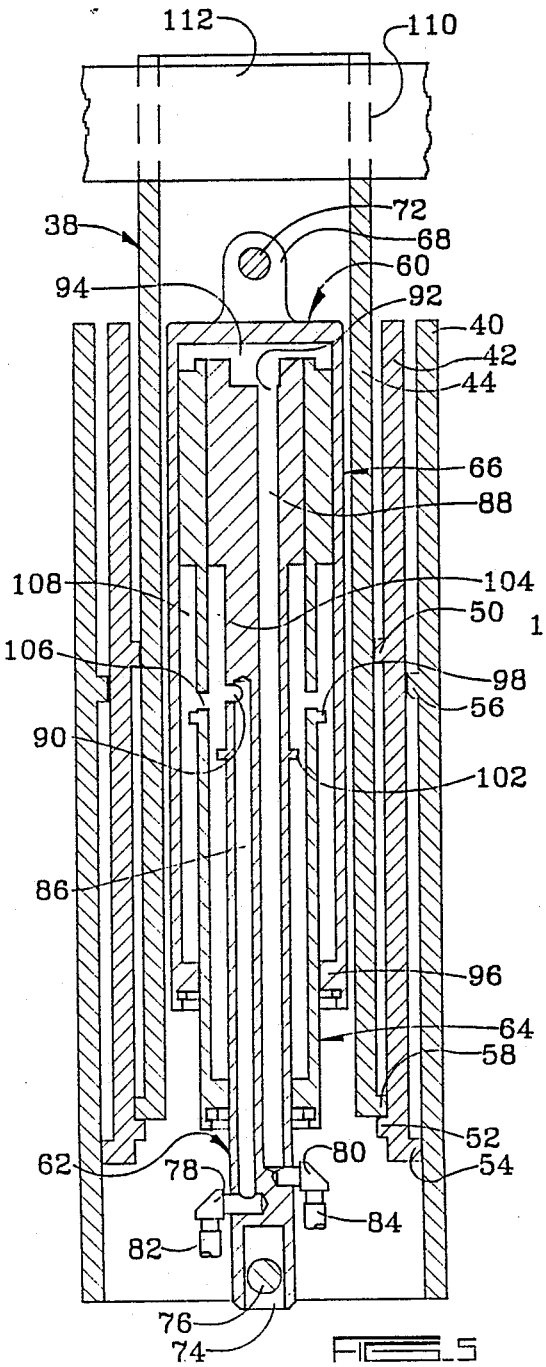
FIGS. 5, 6 and 7 are sectional views showing the hydraulic cylinder assembly in various positions of extension and retraction.

FIG. 5 illustrates a sectional view through the mast or tube assembly 38, showing tube sections 40, 42, 44 telescopically nested within one another. Middle tube section 42 includes upper and lower interior stop flanges 50, 52 and an exterior stop flange 54. Similarly, outer tube section 40 includes an inwardly directed stop flange 56. Upper tube section 44 includes an outwardly directed stop flange 58 located adjacent its lower end. When the upper tube section 44 is extended, the stop flange 58 on the lower end thereof catches against the stop flange 50 on the upper end of tube section 42. As tube section 42 begins to be drawn out of lower tube section 40, the stop flange 54 on the lower end of tube section 42 engages the stop flange 56 on tube section 40 thereby limiting the outward movement thereof.

Mounted within each mast assembly 38 and completely contained therein is a hydraulic cylinder assembly 60 comprising a lower cylinder section 62, a middle cylinder section 64, and an upper cylinder section 66. Upper cylinder section 66 is of the largest diameter and the cylinders are progressively smaller in diameter with the lower cylinder section 62 being the smallest in diameter. The cylinder sections are telescoped within one another in their retracted position as shown in FIG. 5. Upper cylinder section 66 includes a clevis 68 which is secured inside the upper end of upper tube section 44 by means of a pin 72 so as to secure the two together. Similarly, the lower end of cylinder section 62 includes a clevis 74 which is secured to the lower end of lower tube section 40 by means of a pin 76. Thus, extension and retraction of hydraulic cylinder assembly 60 causes extension and retraction of mast or tube assembly 38.

The lower end of lower cylinder section 62 is provided with first and second hydraulic couplings 78, 80 which may be connected to hydraulic lines 82, 84 respectively. Couplings 78, 80 are respectively connected to first and second passage ways 86, 88 which extend longitudinally upwardly within hydraulic cylinder section 62. The first passage way 86 terminates at its upper end at a radial opening 90 which is spaced downwardly from the upper end of lower hydraulic tube section 62. The upper end of passageway 88 extends completely to the upper end of cylinder section 62 and is in communication with an expansion chamber 94 within the upper end of outer cylinder section 66.

In operation pressurized hydraulic fluid is introduced through second hydraulic coupling 80 into second passageway 88 and thence into the expansion chamber 94. This causes the upper hydraulic cylinder section 66 to move upwardly and carry with it the upper tube section 44 of mast assembly 38. Upper hydraulic cylinder section 66 expands upwardly to the position shown in FIG. 6 wherein the inner radial stop flange 96 of outer cylinder section 66 engage the outer stop flange 98 of middle cylinder section 68. Continued introduction of pressurized fluid to chamber 94 through conduit 88 causes the outward movement of middle hydraulic cylinder section 68 to the position shown in FIG. 7. In this position, the inwardly projecting stop flange 100 of middle hydraulic cylinder section 68 engage the outer annular stop flange 102 on the outer surface of lower cylinder section 62 to limit further outward movement thereof. It has been found by the use of the three piece hydraulic cylinder assembly 66 that it is possible to obtain an overall stroke of approximately 11 feet between the extended and retracted positions of cylinder assembly 60.

Retraction of cylinder assembly 60 is accomplished by reversing the flow of fluid so that fluid is removed from chamber 94 through second conduit 88 of lower tube section 62 and outwardly through hydraulic coupling 80 and hydraulic line 84. At the same time, pressurized fluid is introduced through hydraulic line 82, coupling 78, and first conduit 86 into a first retraction chamber 104 which is formed between lower cylinder section 62 and middle cylinder section 64. It should be noted that stop flange 102 on lower cylinder section 62 is spaced radially inwardly from the outer walls of middle cylinder section 64 so as to permit hydraulic fluid to pass there around and exert pressure against the stop flange 100 of middle cylinder section 64. This imparts a downward force to cylinder section 64 which, in combination with the weight of gravity on the cylinder sections, causes middle cylinder section 64 to move downwardly from the position shown in FIG. 7 to the position shown in FIG. 6.

Figure 6:
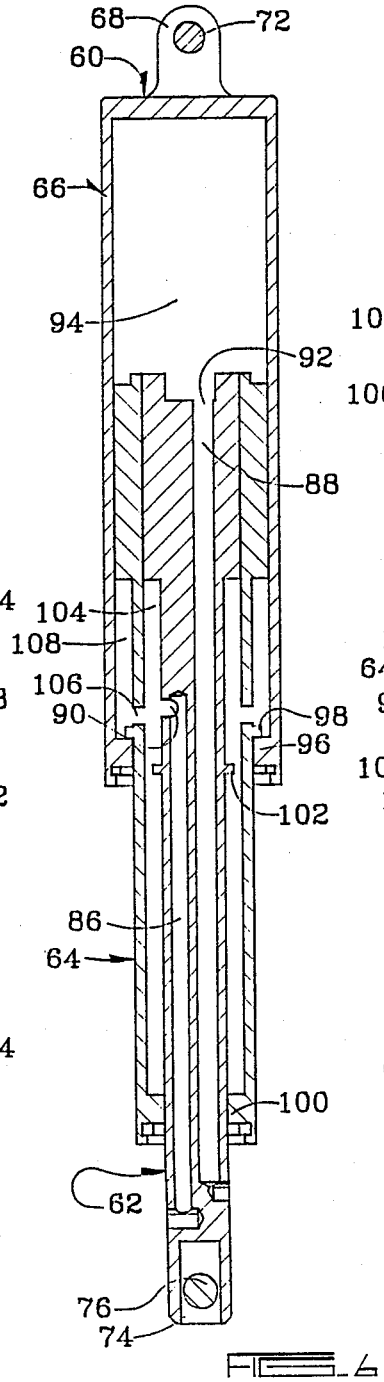
Figure 7:
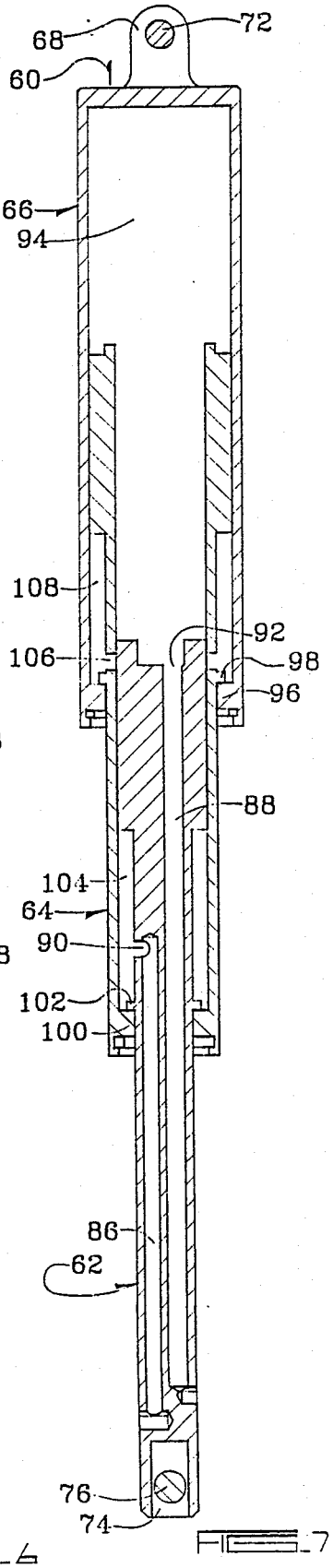
Figure 4:
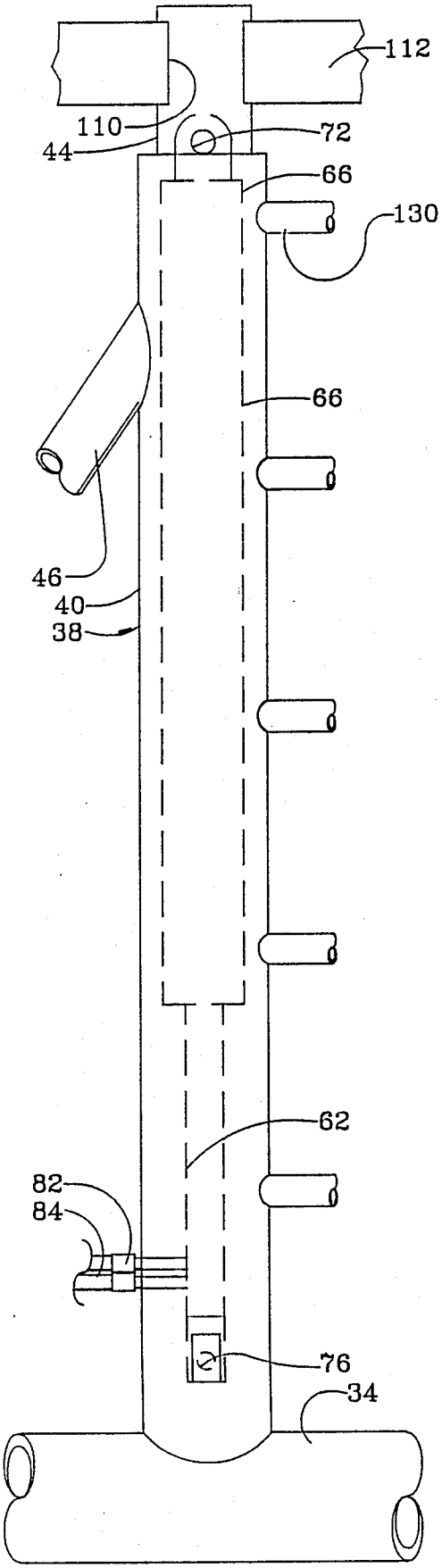
FIG. 4 is an enlarged elevational detail of the rear mast of the present invention.

Continued withdrawal of fluid from chamber 94 when the cylinder is in the position of FIG. 6, and continued introduction of pressurized fluid into first conduit 86 causes further downward movement of the cylinder sections from the position shown in FIG. 6 to the position shown in FIG. 7. This downward movement is facilitated both by the weight of the cylinder assembly 60 and by virtue of the introduction of fluid from first conduit 86 into first fluid chamber 104 and thence through an opening 106 in middle tube section 64. The fluid then passes through opening 106 into a second fluid chamber 108, and passes around stop flanges 98 so as to exert downward pressure on stop flange 96 of upper tube section 66. This causes upper tube section 66 to move downwardly from the position shown in FIG. 6 to the position shown in FIG. 5.

The foregoing structure of hydraulic cylinder assembly 60 permits the use of three cylinder sections within the mast or tube assembly 38 without requiring the introduction of fluid lines and couplings also within the tube assembly or mast assembly 38. Only two hydraulic couplings are provided at the very lower end of the lower most cylinder section, and there is no need for hydraulic lines to be carried upwardly to the upper portions of the tube assembly 38. This elimination of hydraulic lines within the tube assembly 38 makes possible the use of three cylinder sections, while at the same time making possible a greater stoke of the cylinder assembly. It also minimizes the diameter and consequential weight of the mast assembly 38.

Figure 3:
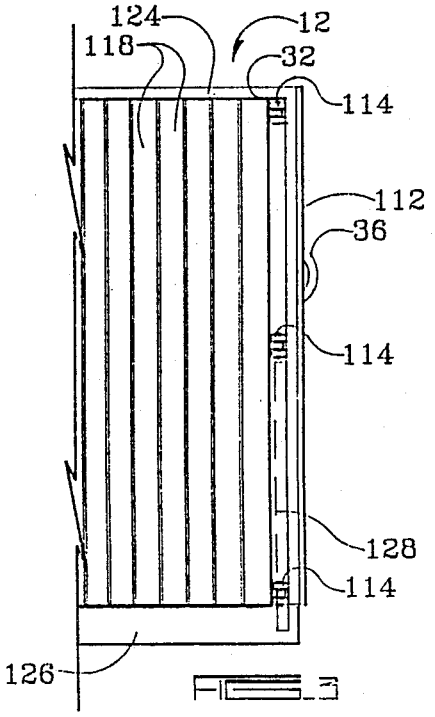
FIG. 3 is a top plan view taken along line 3—3 of FIG. 1.
Figure 8:
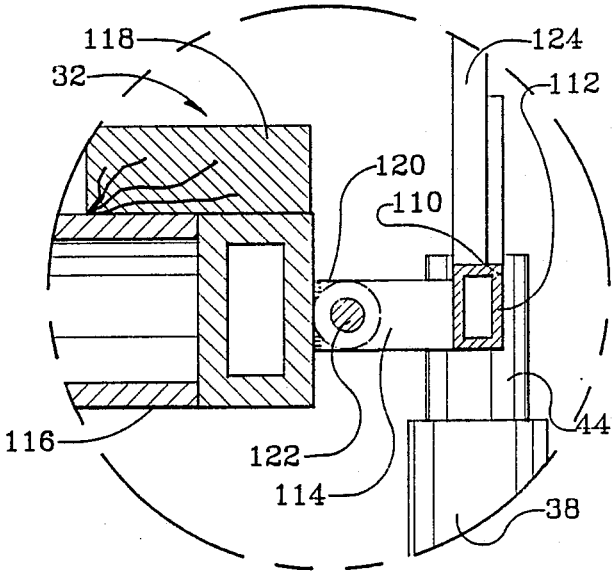
FIG. 8 is an enlarged sectional detail taken along line 8—8 of FIG. 1.
Figure 7:
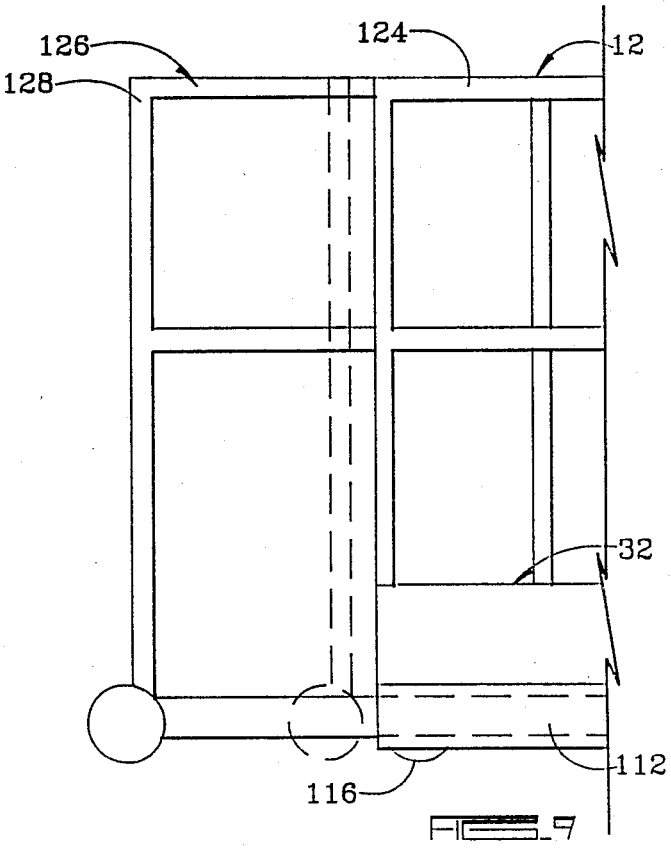

The extreme upper end of each upper tube section 66 includes a U-shaped notch 110 (FIG. 8) in which is seated an upper cross frame member 112 which extends transversely with respect to the direction of movement of vehicle 10. Spaced equidistant along the length of frame member 112 are three hinge flanges 114 (FIG. 3).

Platform assembly 32 comprises a rectangular platform frame 116 across which are laid a plurality of deck planks 118. Attached to the forward and rear ends of platform frame 116 are three hinge flanges 120 which are pivotally connected to flanges 114 for pivotal movement about an axis 122 which extends transversely with respect to the direction of movement of the vehicle. This permits the platform assembly 32 to be adjusted in the event of uneven ground, merely by extending the tube assemblies 38 to the desired distance so as to level the platform from front to rear. For example, on a downward incline slope, the forward tube assembly 38 can be extended further than the rear tube assembly 38, and on an upward slope, the reverse relationship can be used to level the platform assembly 32.

Mounted to the upper surface of platform assembly 32 is a rail guard 124 which extends around the perimeter of platform assembly 32.

Referring to FIG. 9, a platform extension 126 is telescopically mounted within platform frame 116 and is adapted to be telescoped laterally of platform frame 116 as shown in FIG. 9. Platform extension 126 includes an extension rail 128 which also is telescopically mounted with respect to rail guard 124 as shown in FIG. 9.

On rear frame assembly 30, a ladder assembly 130 is rigidly mounted to mast assembly 38 so as to permit persons to have access to the platform assembly 32.

Figure 2:
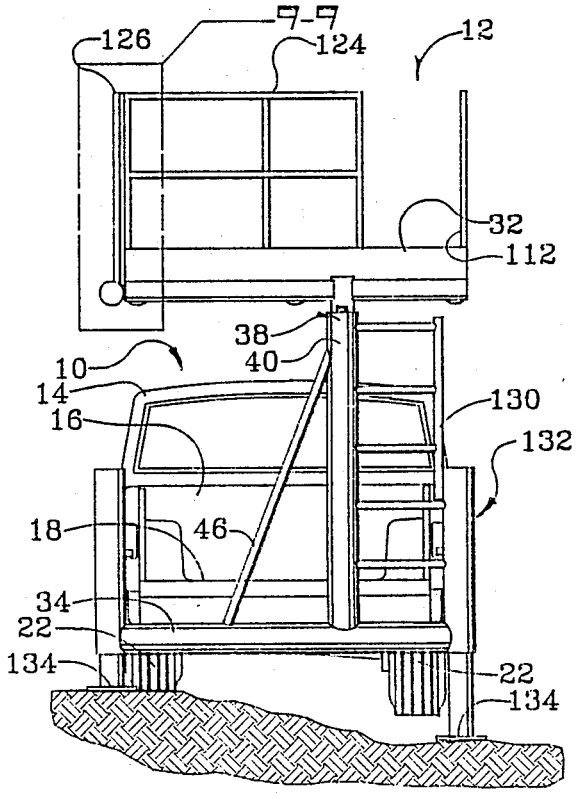
FIG. 2 is a rear elevational view of the device shown in FIG. 1.

Four telescopic outrigger assemblies 132 are located at the four opposite ends of horizontal frame members 34. Outrigger assemblies 132 each include downwardly telescoping feet 134 which can be extended downwardly to engage the ground. As can be seen in FIGS. 1 and 2, these four feet 134 can be extended different distances so as to lift the vehicle and level the vehicle on uneven ground. Each of the outrigger assemblies 132 includes a hydraulic cylinder therein (not shown) for extending and retracting the feet 134. As can be seen in FIGS. 1 and 2, the load of the platform and the load which is carried on the platform are borne by the four feet 134 rather than by the spring or suspension system of the vehicle itself. This is a particular advantage inasmuch as the present portable lift is very light in weight and can be mounted upon a relatively small vehicle compared to the very heavy vehicles which are required for prior portable lifts. The only requirement of the vehicle is that it be capable of transporting the lift from one location to another. However, once the lift is placed in use, the vehicle no longer bears the weight of the lift or of any of the objects supported by the lift. Instead, this weight is borne by the four outrigger feet 134.

Another advantage of the present invention is the fact that the carrying box 16 of vehicle 10 is unobstructed, and is free to carry objects such as tools therein. Many prior devices are mounted within the bed of the truck, and, therefore, preclude the carrying of any objects within the truck bed.

The device is simple in construction, and is very easy to use. Thus it can be seen that the device accomplishes at least all of its stated objectives.

It is claimed that:

1. A portable lift adapted to be connected to a vehicle having forward and rear ends and ground engaging wheels, said lift comprising:

a forward lift frame and a rear lift frame adapted to be connected to said forward and rear ends of said vehicle respectively;

each of said forward and rear lift frames comprising a vertical tube assembly having an upper end and a lower end and having at least two vertical tubes telescopically mounted with respect to one another for telescopic movement from a retracted position wherein said upper end of said tube assembly is at a first level to an extended position wherein said upper end of said tube assembly is located a substantial distance above said first level;

first and second hydraulic extensible power means within said tube assemblies of said forward and rear lift frames respectively for causing raising and lowering of said forward and rear lift frames between said retracted and extended positions;

an elongated support platform having a first end pivotally connected to said upper end of said tube assembly of said forward lift frame and having a second end pivotally connected to said upper end of said tube assembly of said rear lift frame;

each of said forward and rear lift frames comprising a horizontal frame member having opposite ends and being rigidly attached to said lower end of said tube assembly;

an outrigger means connected to each of said opposite ends of said horizontal frame members of said forward and rear lift frames, said outrigger means comprising a vertically movable foot and power means connected to said foot for causing vertical movement thereof to engage a supporting surface so as to permit leveling of said lift;

each of said horizontal frame members of said forward and rear lift frames including securing means thereon for securing said forward and rear lift frames to said forward and rear ends respectively of said vehicle.

2. A portable lift according to claim 1 wherein said first and second hydraulic power means comprise at least a lower elongated extensible member having upper and lower ends, an upper cylinder having an upper cylinder chamber in which said upper end of said lower extensible member is telescopically inserted, said lower extensible member having at least one hydraulic channel extending longitudinally therethrough with an upper channel end in communication with said upper cylinder chamber and with a lower channel end adapted to be connected to a hydraulic line.

3. A portable lift according to claim 2 wherein said lower extensible member includes a second conduit extending longitudinally therethrough and having an upper end spaced below said upper end of said first conduit and having a lower end adjacent said lower end of said lower extensible member.

4. A portable lift according to claim 2 wherein said first and second hydraulic power means comprise an intermedial cylinder telescopically inserted within said upper cylinder, said lower extensible member being telescopically inserted within said intermediate cylinder.

5. A portable lift according to claim 1 wherein said platform includes a longitudinal axis extending between said first and second ends thereof, said pivotal connection of said platform to said forward and rear lift frames being about pivotal axis extending transversely with respect to said longitudinal axis of said platform.

6. A portable lift according to claim 1 wherein said elongated platform includes opposite sides extending between said first and second ends thereof, an extension platform movably mounted to one of said sides of said elongated platform and being movable laterally with respect to said elongated platform from a retracted to an extended position wherein said extension platform increases the effective width of said elongated platform.

7. A portable lift adapted to be connected to a vehicle having forward and rear ends and ground engaging wheels, said lift comprising:

a forward lift frame and a rear lift frame adapted to be connected to said forward and rear ends of said vehicle respectively;

each of said forward and rear lift frames comprising a vertical tube assembly having an upper end and a lower end and having at least two vertical tubes telescopically mounted with respect to one another for telescopic movement from a retracted position wherein said upper end of said tube assembly is at a first level to an extended position wherein said upper end of said tube assembly is located a substantial distance above said first level;

first and second hydraulic extensible power means within said tube assemblies of said forward and rear lift frames respectively for causing raising, and lowering of said forward and rear lift frames between said retracted and extended positions;

an elongated support platform having a first end pivotally connected to said upper end of said tube assembly of said forward lift frame and having a second end pivotally connected to said upper end of said tube assembly of said rear lift frame;

said elongated platform including opposite sides extending between said first and second ends thereof;

an extension platform movably mounted to one of said sides of said elongated platform and being movable laterally with respect to said elongated platform from a retracted to an extended position wherein said extension platform increases the effective width of said elongated platform.

* * * * *